US008412086B2

(12) United States Patent
Matsudaira et al.

(10) Patent No.: US 8,412,086 B2
(45) Date of Patent: Apr. 2, 2013

(54) IMAGE FORMING APPARATUS, CLEAR LAYER FORMING APPARATUS, AND IMAGE FORMING SYSTEM

(75) Inventors: Tadashi Matsudaira, Hachioji (JP); Akihiro Hayashi, Okazaki (JP); Youbao Peng, Hino (JP); Satoshi Ogata, Hachioji (JP); Takashi Nara, Hachioji (JP); Toshiaki Tanaka, Toyokawa (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 315 days.

(21) Appl. No.: 12/827,231

(22) Filed: Jun. 30, 2010

(65) Prior Publication Data

US 2011/0008086 A1 Jan. 13, 2011

(30) Foreign Application Priority Data

Jul. 10, 2009 (JP) ..... 2009-163985

(51) Int. Cl.
*G03G 15/20* (2006.01)

(52) U.S. Cl. ..... 399/341; 399/39; 399/231; 399/342; 156/277

(58) Field of Classification Search ..... 399/147, 399/231, 341, 342, 409, 411; 156/277
See application file for complete search history.

(56) References Cited

U.S. PATENT DOCUMENTS

| | | | | |
|---|---|---|---|---|
| 7,412,198 | B2 * | 8/2008 | Isemura et al. | 399/341 |
| 8,195,077 | B2 * | 6/2012 | Moteki | 399/341 |
| 2005/0244203 | A1 * | 11/2005 | Kamiyama | 399/341 |
| 2006/0133870 | A1 * | 6/2006 | Ng et al. | 399/341 |
| 2006/0198660 | A1 * | 9/2006 | Bessho | 399/223 |
| 2009/0263148 | A1 * | 10/2009 | Omata | 399/39 |
| 2010/0196023 | A1 * | 8/2010 | Shiozawa | 399/39 |

FOREIGN PATENT DOCUMENTS

JP 11-002918 A 1/1999

* cited by examiner

*Primary Examiner* — David Gray
*Assistant Examiner* — Francis Gray
(74) *Attorney, Agent, or Firm* — Buchanan Ingersoll & Rooney PC

(57) ABSTRACT

An image forming apparatus has an image forming section which transfers a toner image according to image data onto a recording sheet, a first fixing section which fixes the toner image with heat of the first fixing roller, a clear layer forming section which forms a clear layer on the toner image which the first fixing section has fixed, a second fixing section which fixes the clear layer with heat of the second fixing roller and a control section which controls the clear layer forming section to increase the thickness of the clear layer in a recording sheet area corresponding to a fixed area during the second revolution of the first fixing roller on the recording sheet, compared with a recording sheet area corresponding to a fixed area during the first revolution thereof.

21 Claims, 7 Drawing Sheets

IMAGE FORMING APPARATUS, CLEAR LAYER FORMING APPARATUS, AND IMAGE FORMING SYSTEM

This application is based on Japanese Patent Application No. 2009-163985 filed on Jul. 10, 2009 with Japanese Patent Office, the entire content of which is hereby incorporated by reference.

BACKGROUND OF THE INVENTION

The present invention relates to an image forming apparatus which forms a toner image with an electro-photographic method, to a clear layer forming apparatus which forms a clear layer on said toner image, and to an image forming system equipped with the image forming apparatus and the clear layer forming apparatus.

In an image forming apparatus of an electro-photographic method, a toner image is formed on the image carrier of a rotating photoreceptor drum or a photoreceptor belt, and the formed toner image is transferred onto a recording sheet directly or indirectly. Furthermore, fixation is carried out, and forming of an image is thus performed.

For the image forming, the toner image transferred electrostatically onto the recording sheet is fixed into a stabilized state on the recording sheet with heat and pressure by a fixing roller.

FIGS. 5*a*, 5*b*, and 5*c* are schematic cross-sectional views showing the appearances of a fixing roller and a recording sheet.

FIG. 5*a* shows that fixation begins to be applied by a fixing roller to the recording sheet onto which the toner image has been transferred. Moreover, FIG. 5*b* shows a state where fixation is being applied by the fixing roller to the recording sheet onto which the toner image has been transferred, and where the fixing roller has completed one revolution after it begins its fixation. Furthermore, FIG. 5*c* shows a state where fixation is being applied or a state at the end of fixation by the fixing roller onto the recording sheet onto which the toner image has been transferred, at the time of a state where the fixing roller has exceeded one revolution after it begins fixation.

In this case, although it depends on the sizes of recording sheets in the auxiliary scanning direction, if it is not a small recording sheet, a fixing roller may start the second revolution on the recording sheet.

In this case, although a high-temperature heater is equipped in the fixing roller, since heat is taken by the recording sheet during the fixation, if a fixing roller has started the second revolution, the fixing temperature is reduced as shown in the figure (a) of FIG. 6.

Thus, when the fixing temperature is reduce, the surface state of the toner which is fixed on a recording sheet changes. As shown in the figure (b) of FIG. 6, and FIG. 7, the phenomenon in which glossiness is slightly reduced occurs. It will seldom become a problem if this phenomenon occurs on a text document, but it may become a problem during formation of images, such as graphical data and an image data.

In addition, a proposal is made by Unexamined Japanese Patent Application Publication No. 11-2918 and others about an image forming apparatus equipped with this type of fixing device.

In Unexamined Japanese Patent Application Publication No. 11-2918, although the proposal about the improvement of a fixing device is made, the glossiness difference of the toner image based on temperature reduction of the fixing roller mentioned above is not considered at all.

SUMMARY

To achieve at least one of the abovementioned objects, an image forming apparatus reflecting one aspect of the present invention comprises the following.

(1) An image forming apparatus including an image forming section which transfers a toner image according to image data onto a recording sheet, a first fixing section which has a first fixing roller which rotates on the recording sheet and which fixes the toner image on the recording sheet with heat of the first fixing roller, a clear layer forming section which forms a clear layer on the toner image which the first fixing section has fixed, a second fixing section which has a second fixing roller which rotates on the recording sheet and which fixes the clear layer on the recording sheet with heat of the second fixing roller, and a control section which controls each part, wherein the control section controls the clear layer forming section to increase a thickness of the clear layer so that the clear layer is thicker in a second recording sheet area than in a first recording sheet area, the first recording sheet area being an area on which the toner image is fixed during a first revolution of the first fixing roller on the recording sheet and the second recording sheet area being an area on which the toner image is fixed during a second revolution of the first fixing roller on the recording sheet.

(2) The image forming apparatus of the above item (1), wherein the control section controls the clear layer forming section to increase a thickness of the clear layer so that the clear layer is thicker in a fourth recording sheet area than in a third recording sheet area, the third recording sheet area being an area on which the clear layer is fixed during a first revolution of the second fixing roller on the recording sheet and the fourth recording sheet area being an area on which the clear layer is fixed during a second revolution of the second fixing roller on the recording sheet.

(3) The image forming apparatus of the above item (1) or (2), wherein the clear layer which the clear layer forming section forms is a transparent toner image made from a transparent toner.

(4) The image forming apparatus of any one of the above items (1)-(3), wherein the control section controls the clear layer forming section to form at least the clear layer in an area of a graphic image where a character image is excluded from a toner image formed by the image forming section.

(5) The image forming apparatus of any one of the above items (1)-(4), wherein the control section controls to change an increase rate of the thickness of the clear layer according to a toner concentration of the toner image formed by the image forming section.

Figure 5A:
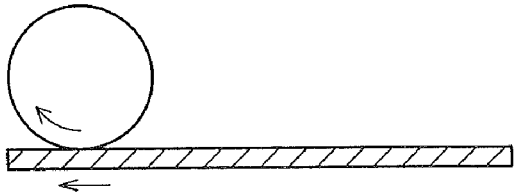
Figure 5B:
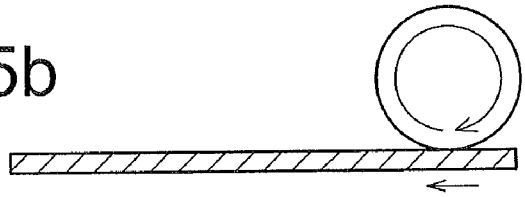
Figure 5C:
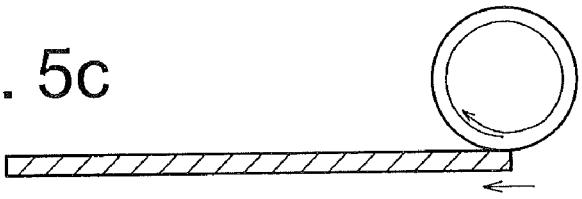

Each of FIGS. 5*a*, 5*b* and 5*c* is an explanatory drawing showing a state at the time of conventional fixation.

Figure 6:
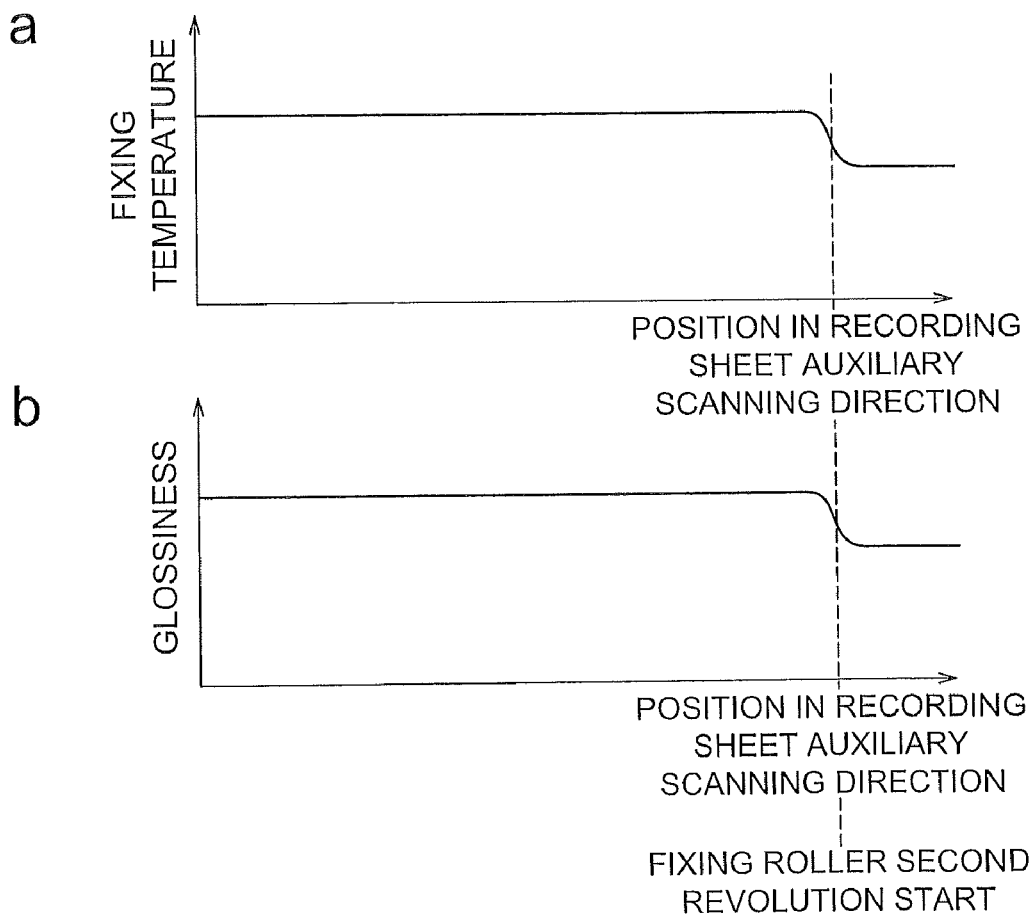

FIG. 6 is an explanatory drawing showing a state at the time of conventional fixation.

Figure 7:
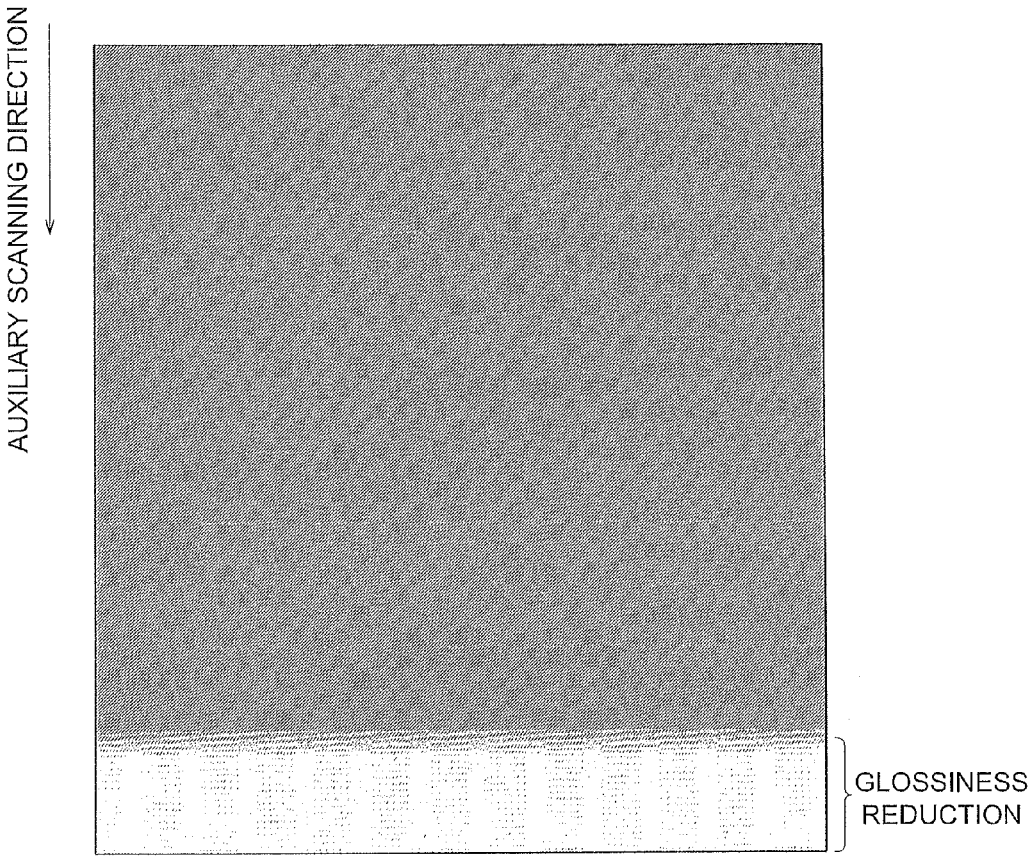

FIG. 7 is an explanatory drawing showing a state at the time of conventional fixation.

DETAILED DESCRIPTION OF THE PREFERRED EMBODIMENTS

Other embodiments are described as follows.

(A) A clear layer forming apparatus which is provided between a first fixing section and a second fixing section of an image forming apparatus and which forms a clear layer which can be fixed by the second fixing section on the toner image which the first fixing section has fixed, wherein the image forming apparatus includes an image forming section which transfers a toner image according to image data onto a recording sheet, the first fixing section which has a first fixing roller which rotates on the recording sheet and which fixes the toner image on the recording sheet with heat of the first fixing roller, and the second fixing section which has a second fixing roller which rotates on the recording sheet on a downstream side of the first fixing section and which fixes the toner image on the recording sheet with heat of the second fixing roller, and wherein the clear layer forming apparatus forms the clear layer so as to increase a thickness of the clear layer so that the clear layer is thicker in a second recording sheet area than in a first recording sheet area, the first recording sheet area being an area on which the toner image is fixed during a first revolution of the first fixing roller on the recording sheet and the second recording sheet area being an area on which the toner image is fixed during a second revolution of the first fixing roller on the recording sheet.

(B) An image forming system including an image forming apparatus including an image forming section which transfers an toner image according to image data onto a recording sheet, a first fixing section which has a first fixing roller which rotates on the recording sheet and which fixes the toner image on the recording sheet with heat of the first fixing roller, a second fixing section which has a second fixing roller which rotates on the recording sheet on a downstream side of the first fixing section and which fixes the toner image on the recording sheet with heat of the second fixing roller, and a control section which controls each part, and a clear layer forming apparatus which is provided between the first fixing section and the second fixing section and which forms a clear layer which can be fixed by the second fixing section on the toner image which the first fixing section has fixed, wherein the clear layer forming apparatus forms the clear layer so as to increase a thickness of the clear layer so that the clear layer is thicker in a second recording sheet area than in a first recording sheet area, the first recording sheet area being an area on which the toner image is fixed during a first revolution of the first fixing roller on the recording sheet and the second recording sheet area being an area on which the toner image is fixed during a second revolution of the first fixing roller on the recording sheet.

According to the above embodiments, the following effects can be acquired.

1. In the embodiment of the image forming apparatus described in the above-mentioned item (1), the image forming apparatus includes a first fixing section in which the toner image transferred onto the recording sheet is fixed with the heat of the first fixing roller, a clear layer forming section which forms a clear layer on the toner image which the first fixing section has fixed, and a second fixing section which fixes a clear layer on the recording sheet with the heat of the second fixing roller which rotates on the recording sheet, and in the image forming apparatus, the clear layer forming section increases the thickness of the clear layer in a recording sheet area corresponding to the fixed area during the second revolution of the first fixing roller on the recording sheet compared with an area corresponding to the first revolution thereof.

Thereby, since control is given in the area in which the glossiness of the toner image on a recording sheet is reduced due to heat reduction on the first fixing roller so that the thickness of the clear layer may become greater, it becomes possible to cancel the glossiness change generated in an image on the recording sheet in connection with the temperature change of the heat fixing.

2. In the embodiment of the image forming apparatus described in the above-mentioned item (2), the clear layer forming section not only increases the thickness of the clear layer in the recording sheet area corresponding to the fixed area during the second revolution of the first fixing roller on the recording sheet compared with the first revolution but also increases the thickness of a clear layer in the recording sheet area corresponding to the fixed area during the second revolution of the second fixing roller on the recording sheet compared with the first revolution.

Thereby, since control is given in the area in which the glossiness of the toner image on a recording sheet is reduced due to each heat reduction of the first fixing roller and the second fixing roller so that the thickness of the clear layer may become greater, it becomes possible to cancel the glossiness change generated in an image on a recording sheet in connection with the temperature change of the heat fixing.

3. In the embodiment of the image forming apparatus described in the above-mentioned item (3), the image forming apparatus includes a first fixing section in which the toner image transferred onto the recording sheet is fixed with the heat of the first fixing roller, a clear layer forming section which forms a clear layer on the toner image which the first fixing section has fixed, and a second fixing section which fixes the clear layer on a recording sheet with the heat of the second fixing roller which rotates on the recording sheet, and in the image forming apparatus, the clear layer forming section increases the thickness of the clear layer, as a toner image made from a transparent toner, in the recording sheet area which corresponds to the fixed area during the second revolution on the recording sheet of the first fixing roller, or the first fixing roller and the second fixing roller compared with the first revolution thereof.

Thereby, in the area in which the glossiness of the toner image on a recording sheet is reduced due to heat reduction of a fixing roller, since control is given so that the thickness of the clear layer made from a transparent toner image may become greater, it becomes possible to cancel the glossiness change generated in an image on a recording sheet in connection with the temperature change of the heat fixing.

4. In the embodiment of the image forming apparatus described in the above-mentioned item (4), the clear layer forming section is controlled to form a clear layer at least in the area of the graphic image excluding a character image out of the toner images formed by the image forming section.

Since control is given in the area of a graphic image in which the glossiness of the toner image on a recording sheet is reduced due to heat reduction of a fixing roller so that the thickness of a clear layer may become greater, it becomes possible to effectively cancel a conspicuous glossiness change in the graphic image area generated in an image on a recording sheet in connection with the temperature change of the heat fixing.

5. In the embodiment of the image forming apparatus described in the above-mentioned item (5), control is given to change the rate to increase the thickness of the clear layer according to the toner concentration (namely density of an image) of the toner image formed by the image forming section.

That is, the rate to increase the thickness of the clear layer is lower when toner concentration is low and a glossiness change cannot be easily noticeable, and the rate to increase the thickness of the clear layer is higher when the toner concentration is high and a glossiness change can be easily noticeable.

Thereby, control is given in the area in which the glossiness of the toner image on a recording sheet is reduced due to heat reduction of a fixing roller so that the thickness of the clear layer may become greater while the difference in toner concentration (image density) is also referred to. Therefore, it becomes possible to cancel the glossiness change generated in an image on a recording sheet in connection with the temperature change of the heat fixing effectively according to the conspicuousness of a glossiness change.

Hereafter, the mode (embodiment) for realizing an image forming apparatus of the present invention is described in detail with reference to drawings.

[Composition of the Image Forming Apparatus 100]

Figure 1:
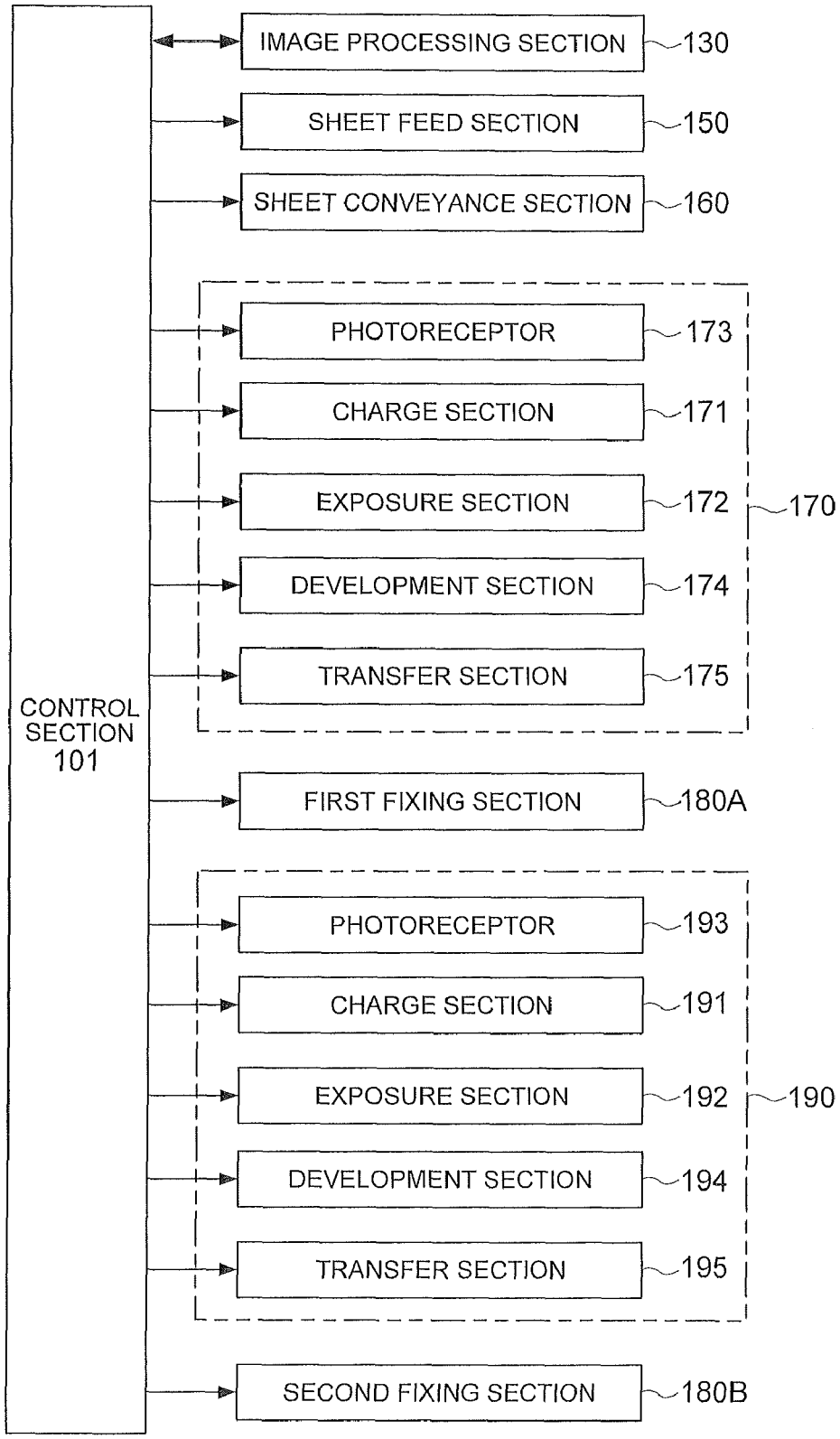
FIG. 1 is a configuration diagram showing the schematic composition of an embodiment of the present invention.
Figure 2:
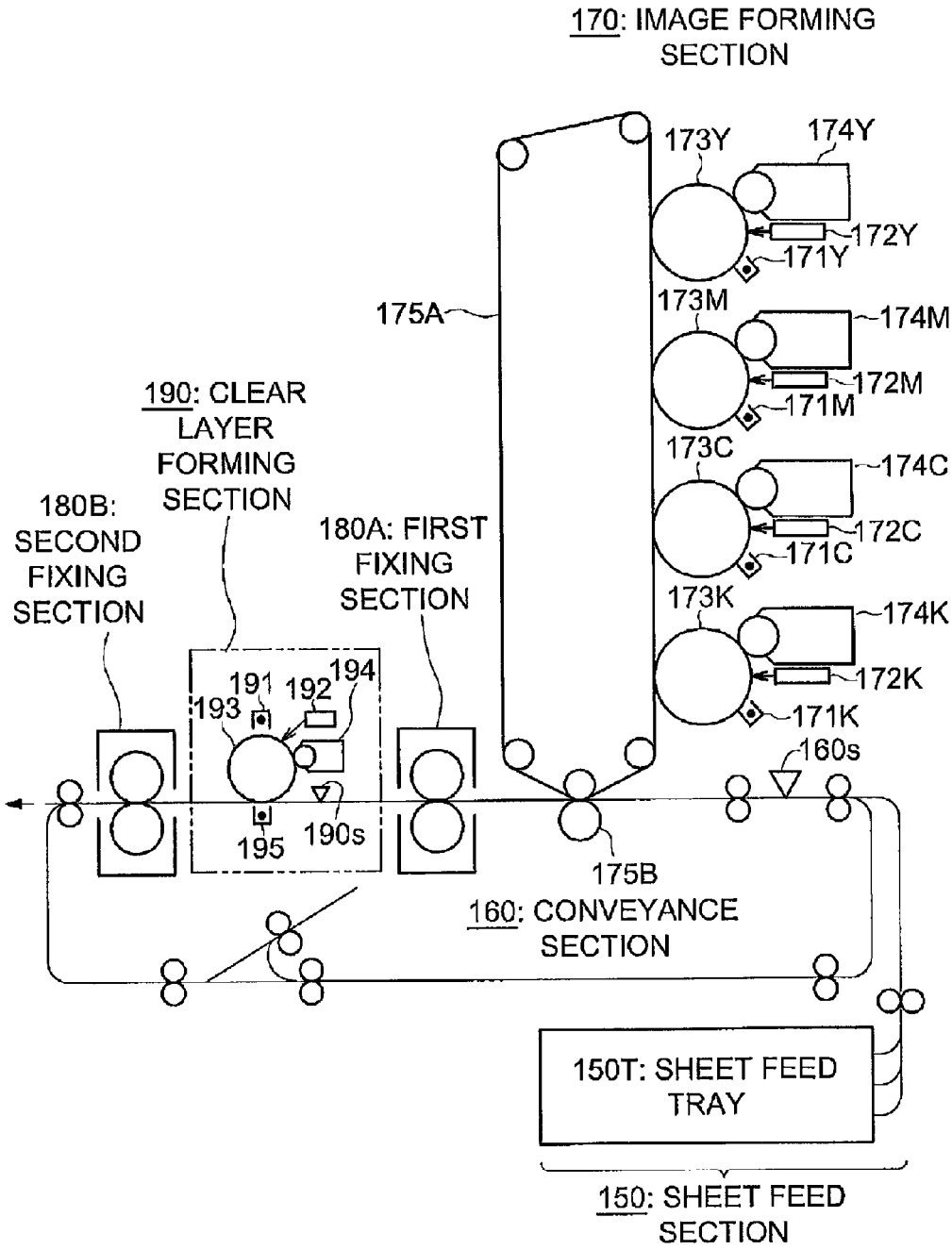
FIG. 2 is a configuration diagram showing the schematic composition of an embodiment of the present invention.

Here, the composition of an image forming apparatus 100 of the electro-photographic type of the first embodiment is described in detail based on FIGS. 1 and 2. In addition, the description about general parts which are well known as in an image forming apparatus 100, and are not directly related to a characteristic operation or control of this embodiment are omitted.

Moreover, the fundamental composition for one color is shown in FIG. 1, and in the case of color-image forming apparatus, as shown in FIG. 2, it is structured so that each part may correspond to each color.

The image forming apparatus 100 includes a control section 101 constituted by a CPU (Central Processing Unit) or the like as a control device by which each part of the image forming apparatus 100 of this embodiment is controlled, an image processing section 130 which performs processing required for the image data to be used for image formation and which is provided with an image memory, the image processing circuit or the like, a sheet feed section 150 which sends out a recording sheet accommodated in the sheet feed tray 150T, a conveyance section 160 which conveys the recording sheet sent out from the sheet feed section 150 at a prescribed conveyance speed while synchronizing it with the timing of image formation by using a sensor 160*s*, an image forming section 170 which forms a toner image on photoreceptors, such as a rotating photoreceptor drum and a photoreceptor belt, and transfers this toner image onto a recording sheet electrostatically, directly or indirectly, and then forms an image, the first fixing section 180A in which the toner image transferred onto the recording sheet is fixed in a stabilized state on the recording sheet with heat and pressure by a fixing roller (the first fixing roller), the second fixing section 180B in which the clear layer formed on the recording sheet is fixed in a stabilized state on the recording sheet with the heat and pressure by a fixing roller (second fixing roller), and a clear layer forming section 190 which forms a clear layer on the recording sheet on which the toner image was formed.

The control section 101 controls each part which constitutes the image forming apparatus 100 according to the control program of the image forming apparatus 100 based on an OS (Operating System) or installed firmware. By performing various types of data processing thereby, the image forming apparatus is collectively controlled.

Moreover, in this embodiment, the control section 101 controls the clear layer forming section 190 to increase the thickness of a clear layer in an area of the recording sheet which corresponds to the fixed area during the second revolution of the first fixing roller on the recording sheet (FIG. 5*c*) compared with the first revolution (FIGS. 5*a*-5*b*).

A sheet feed section 150 is a sheet feeding device to send out the recording sheet stored in one or more paper feed trays 150T to an image forming location with a feeding roller. The conveyance section 160 is a sheet conveying device which conveys the recording sheet sent out from the sheet feed section 150 at a prescribed conveyance speed and is equipped with a registration rollers, other various types of conveying rollers, a conveyance belt and others. Furthermore, conveyance sensors 160*s*, such as a leading-edge detection sensor which detects the leading-edge of a recording sheet, are arranged in the prescribed position of each part of the conveyance section 160.

The image forming section 170 is composed of a charge section 171 which electrifies a photoreceptor at a prescribed voltage, an exposure section 172 which forms an electrostatic latent image by performing exposure the electrified photoreceptor to light according to image data, and changing the electrification voltage on it, a photoreceptor 173 as an image carrier, on the surface of which an electrostatic latent image is formed by the charging and the light exposure, and the electrostatic latent image is changed into a toner image, a development section 174 which allows toner to adhere to the electrostatic latent image formed on the surface of the photoreceptor 173 and is developed to form a toner image, and a transfer section 175 which transfers the toner image formed on the surface of the photoreceptor 173 onto a recording sheet electrostatically.

As for the charge section 171, the exposure section 172, the photoreceptor 173, and the development section 174, the compositions can be independent for every color of YMCK used for image formation respectively as shown in FIG. 2.

Moreover, in the case of the color-image forming apparatus of FIG. 2, as to the transfer section 175, it may have an intermediate transfer member 175A which compounds the toner image of each color of YMCK, and a secondary transfer section 175B which transfers the compounded toner image onto a recording sheet.

The clear layer forming section 190 is composed of a charge section 191 which electrifies a photoreceptor at a prescribed voltage, an exposure section 192 which forms an electrostatic latent image by performing exposure of the electrified photoreceptor to light according to clear layer forming data and changing electrification voltage on it, a photoreceptor 193 as an image carrier, on the surface of which an electrostatic latent image is formed by the charging and light exposure procedure and the electrostatic latent image is changed into a transparent toner image, a development section 194 which allows transparent toner to adhere to the electrostatic latent image formed on the surface of the photoreceptor 193 and develops to make a transparent toner image, and a transfer section 195 which transfers the transparent toner image formed on the surface of the photoreceptor 193 onto a recording sheet electrostatically to make a clear layer. The transparent toner here is a toner whose degree of absorption of visible rays is small and specifically refers to the particles which do not contain coloring agents. In other words, the toner can be called a transparent toner if the image density of the toner at the time of fixing with the transparent toner only is 0.2 (0.5 g/m$^2$ of toner loading amount) or less. In addition, the above-mentioned image density is measured by the reflection meter X-Rite (X-Rite 404).

In addition, although the composition in which the clear layer forming section 190 fowls a clear layer by using transparent toner with an electro-photographic method is shown here, it is also possible to form a clear layer with clearing agents such as transparent ink and a clear coating material by using various methods such as coating, spraying or injection.

This clear layer forming section 190 is arranged between the first fixing section 180A and the second fixing section 180B, and forms a clear layer by using transparent toner on the toner image on the recording sheet fixed by the first fixing roller of the first fixing section 180A. Then, this clear layer is fixed by the second fixing roller of the second fixing section 180B.

In addition, this image forming apparatus may be a printer as shown in FIGS. 1 and 2, and may be a copying machine equipped with a scanner (not shown), and may be a facsimile apparatus or a multi-functional periphery equipped with a scanner or a fax transmission-and-reception section (not shown).

The Operation (1) of an Embodiment

Figure 3:
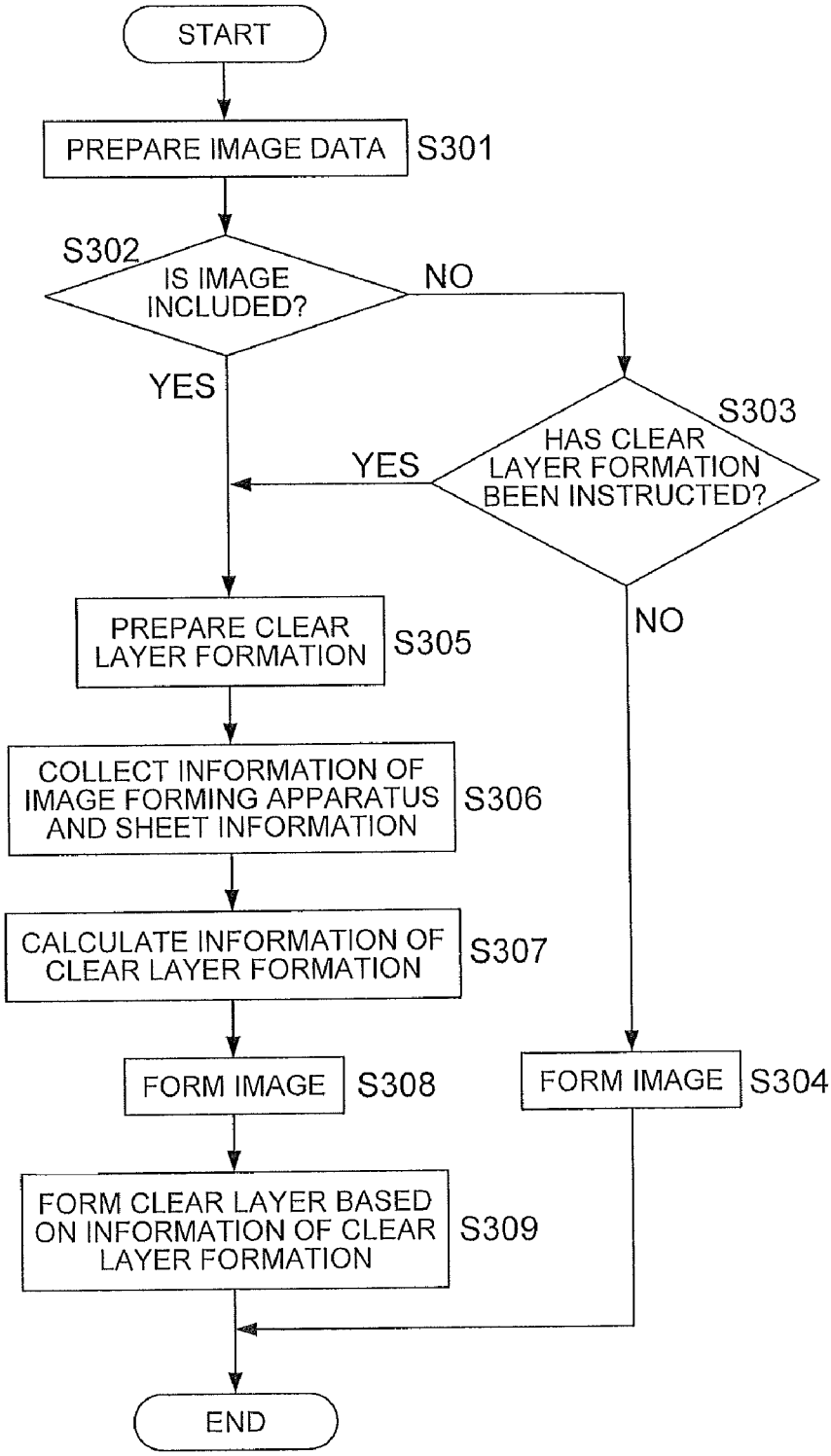
FIG. 3 is a flow chart in which an operation of an embodiment of the present invention is shown.

When instruction of image formation is given from the operation section which is not illustrated, an external instrument or the like, the control section 101 prepares the image data which should be used for image formation, in the image processing section 130 (Step S301 in FIG. 3).

Concerning this image data, image processing required for image formation is performed for the data given from the scanner (not shown), the external instrument or other apparatus, in the image processing section 130.

Moreover, the image processing section 130 judges whether a graphic image area is included in the image data which should be used for image formation according to the instruction from the control section 101 (Step S302 in FIG. 3). Here, graphic images are a photographic image, a computer graphic image, line drawing and the like, and are various types of images except text images. This judgment can be carried out to determine a graphic image area if there is a part of a gradual change of the signal value (shade) included in the image data, whereas to determine a text image area when the signal value changes to the minimum/maximum in a certain range. It is also possible to refer to a code, a flag, or the like which are contained in image data in advance.

In a case where the graphic image area is not included in the image data by the judgment (NO at Step S302 in FIG. 3), when the instruction to form a clear layer is not made even if the image which should be fixated is a text image, (NO at Step S303 in FIG. 3), the toner image according to the image data is transferred onto a recording sheet in the image forming section 170, and the toner image is fixed twice by the first fixing section 180A and the second fixing section 180B and is outputted (Step S304 in FIG. 3).

Thus, it becomes possible to achieve stabilized fixation on various types of recording sheets and at various image forming speeds by fixation by using two fixing sections of the first fixing section 180A and the second fixing section 180B.

When the graphic image area is included in image data according to the judgment on the other hand (YES at Step S302 in FIG. 3), or when instructions are made to form a clear layer (YES at Step S303 in FIG. 3)*even* if the graphic image area is not included in image data according to the judgment (NO at Step S302 in FIG. 3), and the image which should be formed is a text image, the control section 101 instructs the clear layer forming section 190 to prepare the clear layer forming, such as initialization as clear layer forming preparation (Step S305 in FIG. 3).

Further, the control section 101 acquires the diameter (or periphery length) and the fixing temperature of the first fixing roller of the first fixing section 180A, the diameter (or periphery length) and the fixing temperature of a second fixing roller of the second fixing section 180B, the conveyance speed of a recording sheet (image forming speed), recording sheet information such as the thickness and basis weight of the recording sheet, from the nonvolatile memory, job data or others. (Step S306 in FIG. 3).

In addition, if the first fixing roller or the second fixing roller is exchangeable, the control section 101 acquires new data after the exchange.

Such information teaches in which location the glossiness reduction as shown in FIG. 7 occurs in the auxiliary scanning direction of the recording sheet or how much of it occurs.

Figure 4:
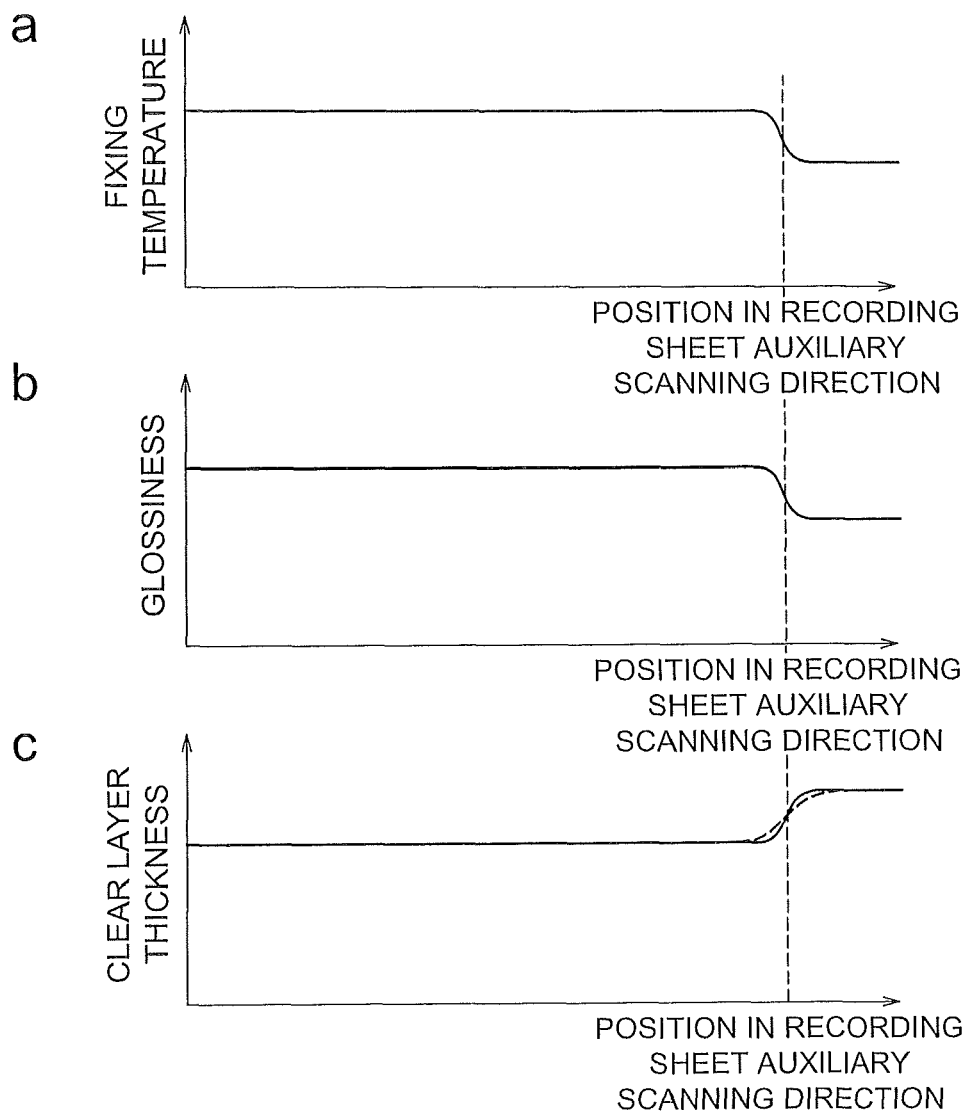
FIG. 4 is a characteristics figure showing an operation of an embodiment of the present invention.

Although a high-temperature heater is provided in the first fixing roller, since heat is taken by the recording sheet during the fixation by the fixing section 180A, if the first fixing roller has started its second revolution, as shown in the figure (a) of FIG. 4, the fixing temperature is reduced. When the first fixing roller has started its second revolution for fixing the recording sheet, a state of the temperature reduction on the surface of the fixing roller is a gradual inclination instead of rectangular sudden reduction because of thermal diffusion on the first fixing roller surface. Therefore, as shown in the figure (b) of FIG. 4, a glossiness reduction of the toner image on the recording sheet fixed by the first fixing section 180A is generated in a state of gradual inclination.

Then, the control section 101 refers to the information acquired as mentioned above (Step S306 in FIG. 3). Clear layer forming information is computed so that a clear layer may be formed in the state where the thickness of the clear layer is increased in the glossiness reduction area on the recording sheet on which the first fixing section 180A has fixed the toner image (Step S307 in FIG. 3).

Specifically, this clear layer forming information is information for controlling to increase the thickness of the clear layer in the glossiness reduction area, as shown in the figure (c) of FIG. 4.

Since the thickness of a clear layer corresponds to the quantity of the transparent toner which forms the clear layer, the control section 101 controls to increase the thickness of the clear layer in the reduction area of glossiness as shown in the figure (c) of FIG. 4. by changing the exposure amount of the exposure section 192, the developing bias of the development section 194, transfer voltage of the transfer section 195, or others according to the transparent toner image data which forms transparent toner images, with the instruction of the control section 101.

In addition, the location where reduction of the glossiness is generated in the auxiliary scanning direction may be slightly changed because of factors such as a change with time of the diameter (peripheral length) of the first fixing roller, a margin of error of the conveyance speed, and a slip of the recording sheet on the first fixing roller. For this reason, the inclined area where the thickness of a clear layer is increased may be extended wider than the area of fixing temperature reduction, as a broken line in figure (c) of FIG. 4 shows.

By control of the control section 101, according to the image data which should be formed, a toner image is formed on a recording sheet by the image forming section 170, and this toner image is fixed by the first fixing section 180A, and then the image formation is carried out (Step S308 in FIG. 3).

Further, a clear layer is formed on the toner image where the clear layer forming section 190 has fixed the image on the recording sheet based on the clear layer forming information mentioned above by control of the control section 101, controlling to increase the thickness of the clear layer in the glossiness reduction area (Step S309 in FIG. 3). Furthermore, the control section 101 sends the recording sheet on which this clear layer has been formed to the second fixing section 180B, and it is fixed so that the clear layer may be stabilized on the toner image.

Thereby, since it is controlled for the area on which the glossiness of the toner image on a recording sheet is reduced due to a heat reduction of the first fixing roller so that the thickness of the clear layer may become greater, it becomes possible to cancel the glossiness change generated in an image on the recording sheet in connection with the temperature change of heat fixing.

In the description of the above embodiment, although the clear layer forming section increases the thickness of the clear layer in a recording sheet area which corresponds to the fixed area during the second revolution of the first fixing roller of the first fixing section 180A on the recording sheet compared with the first revolution thereof. In addition, the control section 101 may control the clear layer forming section 190 to increase the thickness of the clear layer in a recording sheet area which corresponds to the fixed area during the second revolution of the second fixing roller of the second fixing section 180B on the recording sheet compared with the first revolution thereof.

Thereby, since control is given for the area on which the glossiness of the toner image on a recording sheet is reduced due to each heat reduction of the first fixing roller and a second fixing roller so that the thickness of a clear layer may become greater, it becomes possible to cancel the change of the glossiness generated in an image on a recording sheet in connection with the temperature change of heat fixing.

In addition, since the reduction of glossiness is outstanding in a graphic image area, it is desirable to change the thickness of the clear layer, but even when the image is a text image, the thickness of the clear layer may be changed. Moreover, when the graphic image area and the text image area are intermingled, it is desirable to change the thickness of the clear layer on the grounds that at least the graphic image area exists.

Moreover, as mentioned above, since the location of a glossiness reduction area in the auxiliary scanning direction may change, it is also desirable that the user of the image forming apparatus can instruct or change the location in the auxiliary scanning direction where the thickness of the clear layer is changed, the variation amount of the thickness of the clear layer or the like from the operation section, an external instrument, or other devices.

Another Embodiment 1

In addition, although the description of the above embodiments has been done for the image forming apparatus 100 equipped with the clear layer forming section 190, it is not limited to this.

For example, it may be constituted so that the clear layer forming apparatus which can be detached and attached may be incorporated into the image forming apparatus 100' which is equipped with the first fixing section 180A and the second fixing section 180B, and is not equipped with the clear layer forming section 190. In this case, the clear layer forming apparatus may have a control section in it, and the thickness of a clear layer may be controlled by communicating with the control section 101 of image forming apparatus 100', and further the control section 101 may control a clear layer control device.

In this case, by means of a clear layer control device or an image forming system equipped with a clear layer control device, control is given for the area on which the glossiness of the toner image on the recording sheet is reduced due to a heat reduction of a fixing roller so that the thickness of the clear layer becomes greater. Thus, it becomes possible to cancel the change of the glossiness generated in an image on the recording sheet in connection with the temperature change of heat fixing.

Another Embodiment 2

Moreover, although the clear layer forming section 190 or a clear layer control device forms the clear layer on the toner image of a recording sheet using transparent toner in the above description, without being limited to this, it is also possible to form the clear layer whose thickness has been changed by using various methods such as coating, spraying, injection or other methods with a clearing agent such as transparent ink and a clear coating material. Also, due to this, it becomes possible to cancel the glossiness change generated in an image on the recording sheet in connection with the temperature change of heat fixing.

Another Embodiment 3

In the above embodiments, although the color-image forming apparatus of FIG. 2 has been shown as a concrete composition, even if it is monochrome-image forming apparatus, or the image forming apparatus which uses coloring materials of five or more colors other than this, it is possible to apply the present embodiments to them.

What is claimed is:

1. An image forming apparatus comprising:

an image forming section which transfers a toner image according to image data onto a recording sheet;

a first fixing section which has a first fixing roller which rotates on the recording sheet and which fixes the toner image on the recording sheet with heat of the first fixing roller;

a clear layer forming section which forms a clear layer on the toner image which the first fixing section has fixed;

a second fixing section which has a second fixing roller which rotates on the recording sheet and which fixes the clear layer on the recording sheet with heat of the second fixing roller; and a control section which controls each part, wherein the control section determines a first recording sheet area and a second recording sheet area and controls the clear layer forming section to increase a thickness of the clear layer so that the clear layer is thicker in the second recording sheet area than in the first recording sheet area by using information related to the first fixing roller, the first recording sheet area being an area on which the toner image has been fixed during a first revolution of the first fixing roller on the recording sheet and the second recording sheet area being an area on which the toner image has been fixed during a second revolution of the first fixing roller on the recording sheet.

2. The image forming apparatus of claim 1, wherein the control section predicts a third recording sheet area and a fourth recording sheet area and controls the clear layer forming section to increase a thickness of the clear layer so that the clear layer is thicker in the fourth recording sheet area than in the third recording sheet area before fixing by the second fixing roller by using information related to the second fixing roller, the third recording sheet area being an area on which the clear layer is to be fixed during a first revolution of the second fixing roller on the recording sheet and the fourth recording sheet area being an area on which the clear layer is to be fixed during a second revolution of the second fixing roller on the recording sheet.

3. The image forming apparatus of claim 1, wherein the clear layer which the clear layer forming section forms is a transparent toner image made from a transparent toner.

4. The image forming apparatus of claim 1, wherein the control section controls the clear layer forming section to form at least the clear layer in an area of a graphic image where a character image is excluded from a toner image formed by the image forming section.

5. The image forming apparatus of claim 1, wherein the control section further relies on a toner concentration of the toner image formed by the image forming section and fixed by the first fixing roller, and the control section controls to change an increase rate of the thickness of the clear layer according to the toner concentration.

6. A clear layer forming apparatus which is provided between a first fixing section and a second fixing section of an image forming apparatus and which forms a clear layer which can be fixed by the second fixing section on the toner image which the first fixing section has fixed;

wherein the image forming apparatus comprises:

an image forming section which transfers an toner image according to image data onto a recording sheet;

the first fixing section which has a first fixing roller which rotates on the recording sheet and which fixes the toner image on the recording sheet with heat of the first fixing roller; and the second fixing section which has a second fixing roller which rotates on the recording sheet on a downstream side of the first fixing section and which fixes the toner image on the recording sheet with heat of the second fixing roller; and wherein the clear layer forming apparatus determines a first recording sheet area and a second recording sheet area and forms the clear layer so as to increase a thickness of the clear layer so that the clear layer is thicker in the second recording sheet area than in the first recording sheet area by using information related to the first fixing roller, the first recording sheet area being an area on which the toner image has been fixed during a first revolution of the first fixing roller on the recording sheet and the second recording sheet area being an area on which the toner image has been fixed during a second revolution of the first fixing roller on the recording sheet.

7. The clear layer forming apparatus of claim 6, which predicts a third recording sheet area and a fourth recording sheet area and increases a thickness of the clear layer so that the clear layer is thicker in the fourth recording sheet area than in the third recording sheet area before fixing by the second fixing roller by using information related to the second fixing roller, the third recording sheet area being an area on which the toner image is to be fixed during a first revolution of the second fixing roller on the recording sheet and the fourth recording sheet area being an area on which the toner image is to be fixed during a second revolution of the second fixing roller on the recording sheet.

8. The clear layer forming apparatus of claim 6, wherein the clear layer is a transparent toner image made from a transparent toner.

9. The clear layer forming apparatus of claim 6, which forms at least the clear layer in an area of a graphic image where a character image is excluded from a toner image formed by the image forming section.

10. The clear layer forming apparatus of claim 6, wherein the clear layer forming apparatus further relies on a toner concentration of the toner image formed by the image forming section and fixed by the first fixing roller, and the clear layer forming apparatus changes an increase rate of the thickness of the clear layer according to the toner concentration.

11. An image forming system comprising:

(1) an image forming apparatus including:

an image forming section which transfers an toner image according to image data onto a recording sheet;

a first fixing section which has a first fixing roller which rotates on the recording sheet and which fixes the toner image on the recording sheet with heat of the first fixing roller;

a second fixing section which has a second fixing roller which rotates on the recording sheet on a downstream side of the first fixing section and which fixes the toner image on the recording sheet with heat of the second fixing roller; and a control section which controls each part, and (2) a clear layer forming apparatus which is provided between the first fixing section and the second fixing section and which forms a clear layer which can be fixed by the second fixing section on the toner image which the first fixing section has fixed;

wherein the clear layer forming apparatus determines a first recording sheet area and a second recording sheet area and forms the clear layer so as to increase a thickness of the clear layer so that the clear layer is thicker in the second recording sheet area than in the first recording sheet area by using information related to the first fixing roller, the first recording sheet area being an area on which the toner image has been fixed during a first revolution of the first fixing roller on the recording sheet and the second recording sheet area being an area on which the toner image has been fixed during a second revolution of the first fixing roller on the recording sheet.

12. The image forming system of claim 11, wherein the clear layer forming apparatus forms the clear layer so as to increase a thickness of the clear layer so that the clear layer is thicker in the fourth recording sheet area than in the third recording sheet area before fixing by the second fixing roller by using information related to the second fixing roller, the third recording sheet area being an area on which the toner image is to be fixed during a first revolution of the second fixing roller on the recording sheet and the fourth recording sheet area being an area on which the toner image is to be fixed during a second revolution of the second fixing roller on the recording sheet.

13. The image forming system of claim 11, wherein the clear layer which the clear layer forming apparatus forms is a transparent toner image made from a transparent toner.

14. The image forming system of claim 11, wherein the clear layer forming apparatus forms at least the clear layer in an area of a graphic image where a character image is excluded from a toner image formed by the image forming section.

15. The image forming system of claim 11, wherein the clear layer forming apparatus further relies on a toner concentration of the toner image formed by the image forming section and fixed by the first fixing roller, and the clear layer forming apparatus forms the clear layer so as to change an increase rate of the thickness of the clear layer according to the toner concentration.

16. The image forming apparatus of claim 1, wherein the information related to the first fixing roller includes information on a dimension related to a circumferential length of the first fixing roller.

17. The image forming apparatus of claim 1, wherein the information related to the first fixing roller includes information on heating temperature of the first fixing roller.

18. The clear layer forming apparatus of claim 6, wherein the information related to the first fixing roller includes information on a dimension related to a circumferential length of the first fixing roller.

19. The clear layer forming apparatus of claim 6, wherein the information related to the first fixing roller includes information on heating temperature of the first fixing roller.

20. The image forming system of claim 11, wherein the information related to the first fixing roller includes information on a dimension related to a circumferential length of the first fixing roller.

21. The image forming system of claim 11, wherein the information related to the first fixing roller includes information on heating temperature of the first fixing roller.

* * * * *